US007885555B2

(12) United States Patent
Obata

(10) Patent No.: US 7,885,555 B2
(45) Date of Patent: Feb. 8, 2011

(54) IMAGE FORMING APPARATUS WITH MULTIPLE FIXING UNIT ATTACHMENT DETECTION PORTIONS

(75) Inventor: Seiji Obata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 12/400,902

(22) Filed: Mar. 10, 2009

(65) Prior Publication Data

US 2009/0232550 A1 Sep. 17, 2009

(30) Foreign Application Priority Data

Mar. 12, 2008 (JP) ..... 2008-062500

(51) Int. Cl.
*G03G 15/20* (2006.01)

(52) U.S. Cl. ..... 399/13; 399/122

(58) Field of Classification Search ..... 399/13, 399/122, 320, 110

See application file for complete search history.

(56) References Cited

U.S. PATENT DOCUMENTS

| | | | | |
|---|---|---|---|---|
| 5,732,309 | A * | 3/1998 | Okuno et al. | 399/320 X |
| 6,292,638 | B1 * | 9/2001 | Nagamine et al. | 399/122 |
| 2004/0184833 | A1 * | 9/2004 | Ise | 399/122 X |
| 2004/0190939 | A1 * | 9/2004 | Yamanaka | 399/122 |
| 2006/0140675 | A1 * | 6/2006 | Kim et al. | 399/122 |

FOREIGN PATENT DOCUMENTS

| | | |
|---|---|---|
| JP | 63-098559 | 4/1988 |
| JP | 03-102383 | 4/1991 |
| JP | 2971139 B2 | 8/1992 |
| JP | 3012693 B2 | 8/1992 |
| JP | 10-221985 | 8/1998 |
| JP | 11-109830 | 4/1999 |
| JP | 2003-091202 | 3/2003 |
| JP | 2004-054091 | 2/2004 |
| JP | 2004-233823 | 8/2004 |
| JP | 2004-340997 | 12/2004 |
| JP | 2006-215173 | 8/2006 |
| JP | 2007-233306 | 9/2007 |

OTHER PUBLICATIONS

Machine translation of JP 2004-233823 A dated Jun. 12, 2010.*
Machine translation of JP 2006-215173 A dated Jun. 12, 2010.*
Machine translation of JP 2007-233306 A dated Jun. 12, 2010.*

* cited by examiner

*Primary Examiner*—Sophia S Chen
(74) *Attorney, Agent, or Firm*—Fitzpatrick, Cella, Harper & Scinto

(57) ABSTRACT

An image forming apparatus includes a main body and a fixing unit, as well as first and second fixing unit attachment detection portions, each of which includes an optical sensor. The fixing unit is detachably attached to the main body, and includes a unit-side connector which connects with a main body-side connector when the fixing unit is attached to the main body to receive power. The first fixing unit attachment detection portion is at a different position on the main body from where the main body-side connector is located in a longitudinal direction of the fixing unit. The second fixing unit attachment detection portion is at a different position on the main body from where the main body-side connector is located and a position where the first fixing unit attachment detection portion is disposed in the longitudinal direction of the fixing unit.

4 Claims, 9 Drawing Sheets

FIG. 12

| PRESSURE RELEASE DETECTING PORTION | TRANSFER MATERIAL DETECTING PORTION | THE CONDITION WHERE THE FIXING UNIT IS ATTACHED |
|---|---|---|
| ◎ LIGHT-SHIELDING | ◎ LIGHT-SHIELDING | NORMAL |
| ◎ LIGHT-SHIELDING | × TRANSMITTED BEAM | ATTACHMENT FAILURE AT TRANSFER MATERIAL DETECTION PORTION SIDE OR EXISTENCE OF TRANSFER MATERIAL |
| × TRANSMITTED BEAM | ◎ LIGHT-SHIELDING | ATTACHMENT FAILURE AT PRESSURE RELEASE DETECTING PORTION SIDE |
| × TRANSMITTED BEAM | × TRANSMITTED BEAM | ATTACHMENT FAILURE AT BOTH SIDE |

IMAGE FORMING APPARATUS WITH MULTIPLE FIXING UNIT ATTACHMENT DETECTION PORTIONS

BACKGROUND OF THE INVENTION

1. Field of the Invention

The present invention relates to an electrophotographic or an electrostatic-recording image forming apparatus, and more particularly relates to an image forming apparatus such as a copier, a laser beam printer, or a facsimile that are capable of forming a visual image on an image bearing member and transferring the visual image on a transfer material to obtain an image.

2. Related Background Art

Image forming apparatuses such as electrophotographic copier and printer are equipped with a fixing unit that heats a toner image formed on a recording material (transfer material) for fixing. As the fixing unit is used repeatedly, a fixing roller may generate a flaw on the surface or a pressure roller may generate a wrinkle on the surface, and such a flaw or a wrinkle causes a failure in fixing or in image formation, and therefore a roller has to be replaced periodically.

Further, the fixing unit may have to be detachable and attachable so as to allow for a trouble in the fixing unit of the transfer material such as a paper jam due to some reasons, so as to remove the transfer material easily. To this end, the fixing unit is generally configured to allow a serviceman and a user to detach/attach it.

The fixing unit is further provided with a component to establish electrical connection with a main body of the image forming apparatus so as to feed electricity to a heater, a thermistor, and a thermo-switch therein. As such a component, a drawer connector is typically used.

When the fixing unit is attached to the main body of the apparatus, a fixing unit-side drawer connector provided in the fixing unit is fitted with a main body-side drawer connector in the apparatus main body for coupling. Then, connector terminals in the connectors in number corresponding to electrical connection required are brought into contact with each other, so as to establish electrical connection of the components such as the heater, the thermistor, and the thermo-switch. The draw connectors used for this purpose typically have many connection terminals to feed electricity to a plurality of components, thus often requiring a force to detach and attach it.

When an image forming apparatus includes a fixing unit that is detachable/attachable with respect to the apparatus main body, such an image forming apparatus is normally equipped with an attachment detection function enabling detection whether the fixing unit is attached or not to the apparatus main body. If an attachment detection judgment portion determines that the fixing unit is not attached, then an operation of the image forming apparatus is prohibited. To detect the attachment, electrical connection between the terminals in the above-stated connectors is detected, for example.

However, even when the above-stated connectors are inserted to predetermined positions of the apparatus main body, other portions of the fixing unit may not be inserted to their predetermined positions. Further, the above-stated drawer connectors that feed electricity to the fixing unit may not be inserted completely to the end physically even when the connector terminals between the fixing unit-side and the apparatus main body-side are electrically connected.

As one of the methods of detecting attachment of a fixing unit, Japanese Patent Application Laid-Open No. 2007-233306 discloses a method of detecting attachment at two positions in the longitudinal direction of a fixing unit. The technique disclosed detects an attachment state at the two positions so as to prevent an image forming apparatus from printing while the fixing unit being attached inclined with reference to the apparatus main body.

However, as described above, the drawer connectors that feed electricity to the fixing unit may not be inserted completely to the end physically even when the connector terminals between the fixing unit-side and the apparatus main body-side are electrically connected. Therefore, the disclosed technique cannot completely prevent the case where a printing operation is permitted even when the fixing unit is aligned obliquely with reference to the correct direction of the image forming apparatus main body. When the printing operation is performed while the fixing unit being aligned obliquely with reference to the correct direction of the image forming apparatus main body, there is a high possibility for a recording material to cause jam at the fixing unit portion.

SUMMARY OF THE INVENTION

In view of the above-stated problems, it is an object of the present invention to provide an image forming apparatus capable of suppressing an attachment failure of a fixing unit.

It is another object of the present invention to provide an image forming apparatus capable of judging an attachment state of a fixing unit accurately.

It is still another object of the present invention to provide an image forming apparatus including: an image forming apparatus main body; a fixing unit detachably attached to said image forming apparatus main body, said fixing unit including a unit-side connector that electrically connects with a main body-side connector of said image forming apparatus main body when said fixing unit is attached to said image forming apparatus main body to receive electric power from said image forming apparatus main body; a first fixing unit attachment detection portion that is disposed at a position on said image forming apparatus main body different from a position where said main body-side connector of said image forming apparatus main body is disposed in a longitudinal direction of said fixing unit; and a second fixing unit attachment detection portion that is disposed at a position on said image forming apparatus main body different from a position where said main body-side connector of said image forming apparatus main body is disposed and a position where said first fixing unit attachment detection portion is disposed in the longitudinal direction of said fixing unit.

Further features of the present invention will become apparent from the following description of exemplary embodiments with reference to the attached drawings.

BRIEF DESCRIPTION OF THE DRAWINGS

FIG. 12 illustrates a relationship between the detection state by a pressure release detection flag and a transfer material detection flag and an attachment state of the fixing unit.

DETAILED DESCRIPTION OF THE INVENTION

Figure 1:
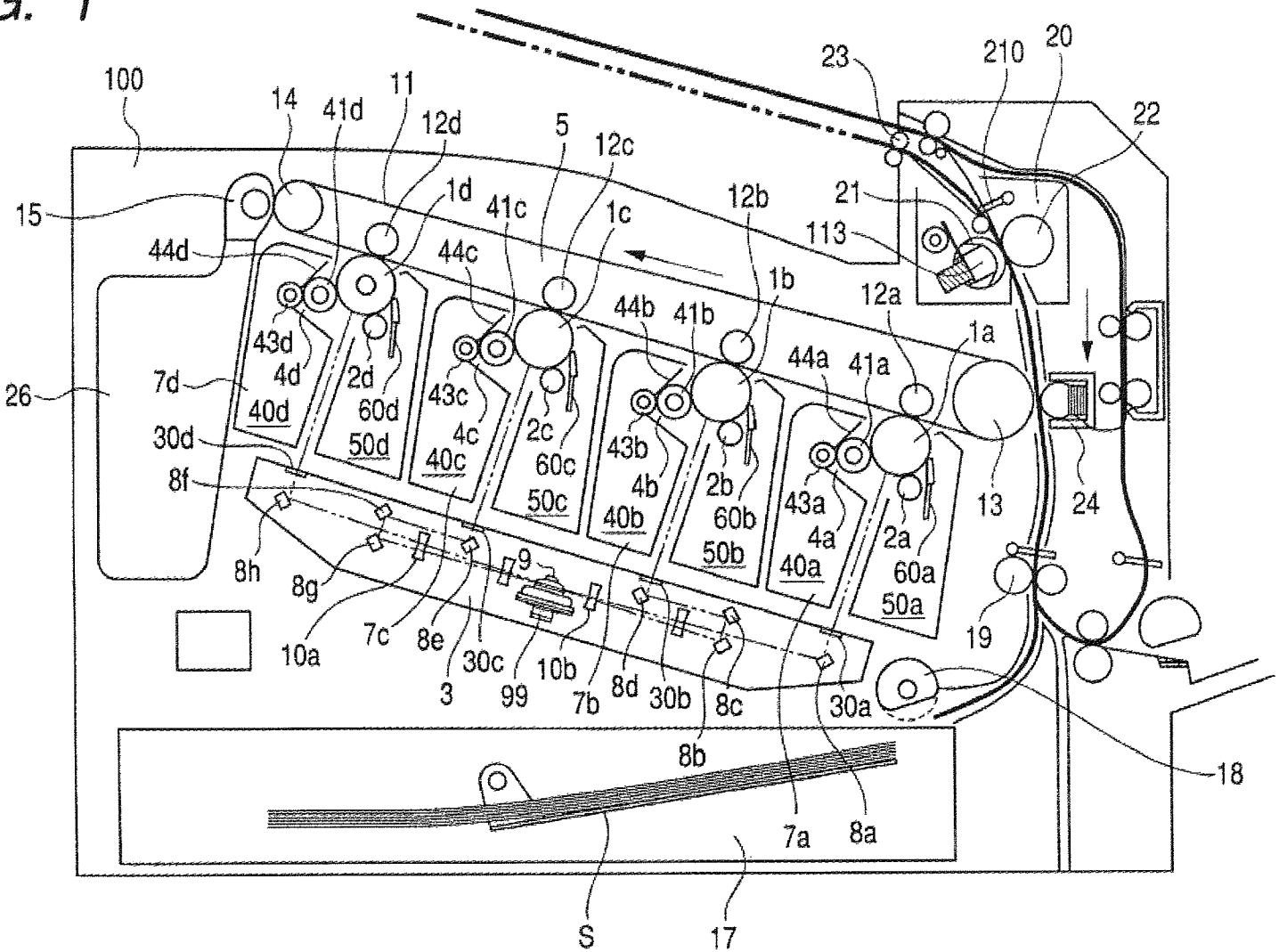
FIG. 1 is a schematic cross-sectional view illustrating the configuration of an image forming apparatus according to one embodiment of the present invention.

The following describes embodiments of the present invention in detail with reference to the drawings. FIG. 1 is a cross-sectional view illustrating the overall configuration of an electrophotographic full-color laser beam printer that is an image forming apparatus according to one embodiment of the present invention.

Overall Configuration of Image Forming Apparatus

In FIG. 1, an image forming apparatus 100 roughly includes an image formation portion, a feeding/transferring portion, a fixing portion, and a discharge portion. The image formation portion is provided at a center portion of the apparatus, the feeding/transferring portion is located from the lower right to the upper right of FIG. 1, and the fixing portion is located at the right uppermost of the same.

(Image Forming Portion)

Firstly, the image forming portion will be described below. The image forming apparatus 100 includes four drum-shaped electrophotographic photosensitive members 1*a* to 1*d* (hereinafter called "photosensitive drums") as image bearing members disposed horizontally in parallel with each other.

The photosensitive drums 1*a* to 1*d* are rotary-driven clockwise in the drawing by a driving unit (not illustrated). Around the photosensitive drums 1*a* to 1*d* are disposed charge apparatuses 2*a* to 2*d*, respectively, in the order of the rotary direction and an exposure apparatus 3, where the charge apparatuses 2*a* to 2*d* uniformly charge the surfaces of the photosensitive drums 1*a* to 1*d*, respectively, and the exposure apparatus 3 applies an optical image in accordance with image information. In the present embodiment, the exposure apparatus 3 is configured as a scanner unit that applies a laser beam in accordance with the image information so as to form electrostatic latent images on the photosensitive drums 1*a* to 1*d*.

Around the photosensitive drums 1*a* to 1*d* are further disposed developing apparatuses 4*a* to 4*d* and an intermediate transferring unit 5, where the developing apparatuses 4*a* to 4*d* let toner attached to the electrostatic latent images on the photosensitive drums 1*a* to 1*d*, respectively, to develop the electrostatic latent images as toner images, and the intermediate transferring unit 5 primary-transfers the toner images on the photosensitive drums 1*a* to 1*d* to an intermediate transferring belt 11. On the downstream side along the intermediate transferring belt 11 with reference to the primary transferring portion where the intermediate transferring unit 5 and the photosensitive drums 1*a* to 1*d* come into contact with, a secondary transferring unit 24 is disposed so as to secondary-transfer the toner image on the intermediate transferring belt 11 to a transfer material S.

Around the photosensitive drums 1*a* to 1*d* are further disposed cleaning blades 60*a* do 60*d*, respectively, so as to remove residual toner remaining on the surfaces of the photosensitive drums 1*a* to 1*d* after the transfer.

In the present embodiment, the photosensitive drums 1*a* to 1*d*, the charge apparatuses 2*a* to 2*d*, the developing apparatuses 4*a* to 4*d*, and the cleaning blades 60*a* to 60*d* are configured integrally as cartridges so as to form process cartridges 7*a* to 7*d*, respectively, that are detachable/attachable with respect to the image forming apparatus.

The process cartridges 7*a* to 7*d* are segmented into photosensitive drum units 50*a* to 50*d* and developing units 40*a* to 40*d*, respectively, where the photosensitive drum units 50*a* to 50*d* include the photosensitive drums 1*a* to 1*d*, the charge apparatuses 2*a* to 2*d*, and the cleaning blades 60*a* to 60*d*, respectively, and the developing units 40*a* to 40*d* include the developing apparatus 4*a* to 4*d*, respectively. The following describes the respective units in detail one by one, starting from the photosensitive drums 1*a* to 1*d*.

The photosensitive drums 1*a* to 1*d* are each configured of an aluminum cylinder of 30 mm in diameter with an organic photo-conductive layer (an OPC photosensitive member) applied on a periphery thereof. The photosensitive drums 1*a* to 1*d* are each supported rotatably at both ends by a supporting member, to one end of which a driving force from a driving motor (not illustrated) is transmitted, whereby each photosensitive drum is rotary-driven counterclockwise.

As the charge apparatuses 2*a* to 2*d*, contact electrification apparatuses can be used. In the present embodiment, charge members of the charge apparatuses 2*a* to 2*d* used are conductive rollers formed in a roller shape. The charge apparatuses 2*a* to 2*d* are brought into contact with the surfaces of the photosensitive drums 1*a* to 1*d*, respectively, while applying charge bias voltages to the charge apparatuses 2*a* to 2*d*, whereby the surfaces of the photosensitive drums 1*a* to 1*d* can be charged uniformly.

The scanner unit 3 includes a polygon mirror 9 that is rotated at a high speed by a scanner motor 99, and a laser diode (not illustrated) applies image light corresponding to an image signal to the polygon mirror 9. The image light reflected by the polygon mirror 9 passes through imaging lenses 10*a* and 10*b*, reflection mirrors 8*a* to 8*h*, dust prevention glasses 30*a* to 30*d*, and the like, which then exposes the charged surfaces of the photosensitive drums 1*a* to 1*d* selectively, thus forming electrostatic latent images thereon.

Above the dust prevention glasses 30*a* to 30*d* of the scanner unit 3 is provided a shielding member (not illustrated) that shields the image light and a slit to secure an optical path. The shielding member (not illustrated) is attached to be rotary-movable so as to allow an electrostatic latent image to be formed when the process cartridges 7*a* to 7*d* are attached.

The developing apparatuses 4*a* to 4*d* include developer storing portions that store toner of yellow, magenta, cyan, and black, respectively, i.e., toner containers (not illustrated), and developing frame members, i.e., developing containers (not illustrated). The toner containers (not illustrated) include developing rollers 41*a* to 41*d* therein that face the photosensitive drums 1*a* to 1*d*, respectively, the developing rollers 41*a* to 41*d* functioning as developer bearing members that bear and convey a developer.

The developer in the toner containers (not illustrated), i.e., the toner is fed to toner supplying rollers 43*a* to 43*d* by a toner conveying/agitation mechanism (not illustrated). Then, the toner is applied to periphery of the developing rollers 41*a* to 41*d* by the toner supplying rollers 43*a* to 43*d* and developing blades 44*a* to 44*d*, respectively, that are brought into contact with the periphery of the developing rollers 41*a* to 41*d* by pressurizing, and the toner is electrically charged.

Then, developing bias is applied to the developing rollers 41*a* to 41*d*, thus developing the latent images formed on the photosensitive drums 1*a* to 1*d*, respectively, to obtain toner images.

The developing apparatuses 4*a* to 4*d* have a so-called hanging configuration where the developing apparatuses 4*a* to 4*d* as a whole are supported swingably with respect to the photosensitive drum units 50*a* to 50*d*, respectively. Each of the developing apparatus 4*a* to 4*d* can move swingably by a pin about a supporting shaft (not illustrated) provided at a shaft bearing member (not illustrated) attached at both ends of the developing apparatus.

When the process cartridges 7*a* to 7*d* are not attached to the image forming apparatus 100, the developing apparatuses 4*a* to 4*d* are always urged in one direction by a pressure spring (not illustrated). Thereby, the developing rollers 41*a* to 41*d* come into contact with the photosensitive drums 1*a* to 1*d*, respectively.

The toner containers (not illustrated) of the developing apparatuses 4*a* to 4*d* are brought into contact with an abutment changing unit (not illustrated) of the apparatus main body 100 when the developing rollers 41*a* to 41*d* are made away from the photosensitive drums 1*a* to 1*d*, respectively, so as to couple with the abutment changing unit functionally. To this end, a dividing boss (not illustrated) functioning to receive the action is integrally provided.

Although not illustrated, the developing units 40*a* to 40*d* each include a toner remaining amount detection mechanism, which lets LED light pass through the toner container and senses a passage time so as to detect a remaining amount of the toner.

The intermediate transferring belt 11 is disposed so as to face all of the photosensitive drums 1*a* to 1*d* and circulatory-moves while being in contact with the photosensitive drums 1*a* to 1*d*. The intermediate transferring belt 11 is made of a film member with a volume resistivity of $10^{11}$ to $10^{14}$ Q·cm and a thickness of about 150 μm.

The intermediate transferring belt 11 is supported by two shafts of rollers 13 and 14 in the horizontal direction, and the intermediate transferring belt 11 circulatory-moves so as to transfer the toner images of the respective colors formed on the photosensitive drums 1*a* to 1*d* onto the recording material S via the same.

Primary transfer members 12*a* to 12*d* are disposed in parallel so as to come into contact with the inside of the intermediate transferring belt 11 and at positions facing the four photosensitive drums 1*a* to 1*d*, respectively. These primary transfer members 12*a* to 12*d* apply a positive-polarity voltage to the intermediate transferring belt 11, so that electric field generated by the voltage causes negative-polarity toner images on the photosensitive drums 1*a* to 1*d* to be primary-transferred onto the intermediate transferring belt 11.

The intermediate transferring belt 11 is of about 700 mm in perimeter length and about 150 μm in thickness, and is hung over the two rollers of the driving roller 13 and the tension roller 14 so as to rotate in the direction indicated by the arrow in the drawing.

Secondary transfer member 24 is further disposed at a position facing the driving roller 13 of the intermediate transfer unit 5. Similarly to the primary transfer members 12*a* to 12*d*, the secondary transfer member 24 applies a positive-polarity voltage to the recording material S conveyed to the secondary transferring portion.

Electric field generated by this voltage causes the negative-polarity toner image that has been primary-transferred to the intermediate transferring belt 11 to be secondary-transferred onto the recording material S coming into contact with the intermediate transferring belt 11. Thus, as the intermediate transferring belt 11 circulatory-moves as described above, the toner images formed on the photosensitive drums 1*a* to 1*d* are transferred onto the recording material S.

A cleaning apparatus 15 is further disposed at a position facing the tension roller 14 of the intermediate transfer unit 5 to remove the residual toner remaining on the intermediate transferring belt 11 after the secondary transfer. The removed toner passes through a waste toner conveying path and is collected to a waste toner collection container 26.

(Feeding Portion)

The feeding portion feeds and conveys the transfer material S to the secondary transferring portion where an image on the intermediate transferring belt 11 is transferred onto the transfer material S. The transfer material S is stored in a feeding cassette 17.

When an image is formed, a feeding roller 18 (semicircular roller) feeds a transfer material S at the uppermost position of the feeding cassette 17, so as to let the leading edge of the transfer material S come into contact with a resist roller pair 19 and stop temporarily. Then, after letting the transfer material S bend, the transfer material S is fed to the secondary transferring portion through the resist roller pair 19 while synchronizing the rotation of the intermediate transferring belt 11 and an image writing position.

(Fixing/Discharge Portion)

The fixing portion, i.e., the fixing unit 20 fixes the toner images of a plurality of colors transferred to the transfer material S, and includes a rotating fixing roller 21, and a pressure roller 22 that comes into contact with the fixing roller 21 by pressurizing and applies heat and pressure to the transfer material S. Downstream of the fixing unit 20 is provided a discharge roller pair 23 that discharges the transfer material S outside the apparatus main body.

Figure 2:
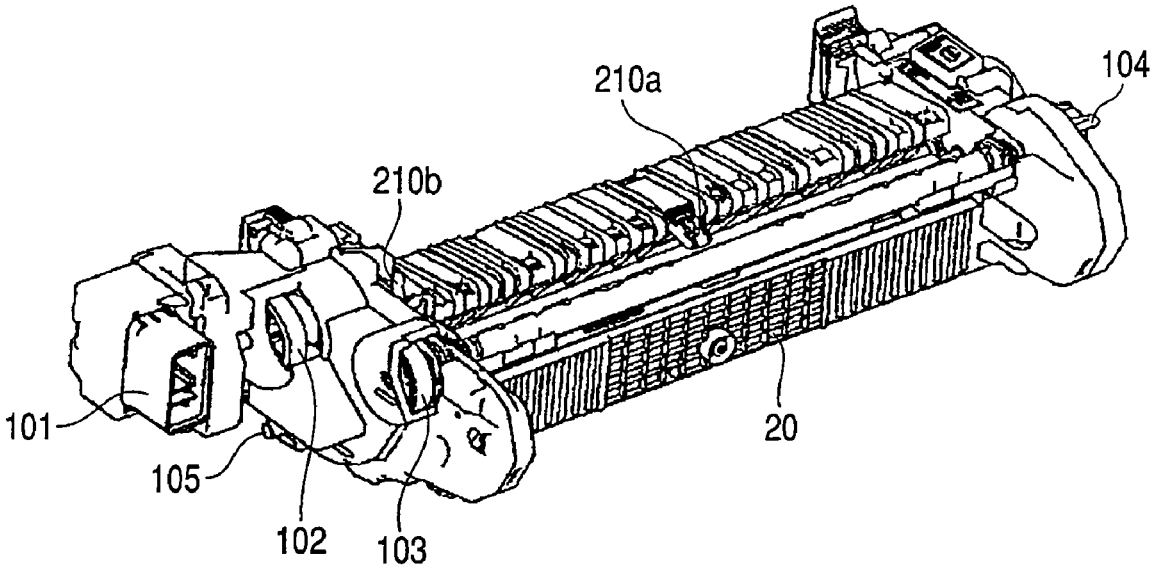
FIG. 2 is a perspective view of a fixing unit that is detached and attached with respect to the image forming apparatus of FIG. 1.

Between the fixing roller pair 21, 22 and the discharge roller pair 23 is disposed a transfer material detection flag 210 that monitors whether the transfer material S can be discharged surely outside of the main body and whether the transfer material S is wound around the fixing roller pair 21, 22 or not. As illustrated in FIG. 2, the transfer material detection flag 210 is attached to the fixing unit 20, and includes a portion 210*a* that comes into contact with the transfer material S and a flag portion (second flag) 210*b* that acts on a second fixing unit attachment detection portion (optical sensor) 211 described later.

When the transfer material S with the toner images on the photosensitive drums 1*a* to 1*d* transferred thereon passes through the fixing unit 20, the transfer material S is pinched between the fixing roller pair 21, 22 for conveying, while being heated or pressurized by the fixing roller pair 21, 22. As a result, the toner images of a plurality of colors are fixed on the surface of the transfer material S. The configuration and the operation of the fixing unit 20 will be described later in detail.

(Operation of Image Formation)

An image is formed through the operation of driving the process cartridges 7*a* to 7*d* successively in accordance with a printing timing, and thus rotary-driving the photosensitive drums 1*a* to 1*d* clockwise in accordance with the driving of the process cartridges 7*a* to 7*d*.

Then, the scanner unit 3 corresponding to all of the process cartridges 7*a* to 7*d* is driven. This driving allows the charge apparatuses 2*a* to 2*d* to uniformly charge the peripheral surfaces of the photosensitive drums 1*a* to 1*d*, respectively, and the scanner unit 3 exposes the peripheral surfaces of the photosensitive drums 1*a* to 1*d* in accordance with an image signal so as to form electrostatic latent images on the peripheral surfaces of the photosensitive drums 1*a* to 1*d*.

The developing rollers 41*a* to 41*d* in the developing apparatuses 4*a* to 4*d* cause toner to be transferred to a lower-potential portion of the electrostatic latent image, so as to form (develop) toner images on the peripheral surfaces of the photosensitive drums 1*a* to 1*d*, respectively. The toner images of respective colors formed on the peripheral surfaces of the photosensitive drums 1*a* to 1*d* are primary-transferred onto the intermediate transferring belt 11 while synchronizing the respective colors of image positions. At this time, when the toner images of all colors have been primary-transferred, a full-color toner image can be formed on the intermediate transferring belt 11.

The leading edge of the toner image on the peripheral surface of the intermediate transferring belt 11 is rotary-conveyed at a facing point between the intermediate transferring belt 11 and the secondary transfer member 24. At this timing, the resist roller pair 19 starts to rotate so that the printing starting position of the transfer material S agrees with the leading edge of the toner image on the intermediate transferring belt 11, and then feeds the transfer material S to the secondary transferring portion.

As being conveyed as stated above, the toner image on the intermediate transferring belt 11 is transferred to the recording material S because of electric field generated between the intermediate transferring belt 11 and the secondary transfer member 24.

Thereafter, the recording material S with the full-color toner image transferred thereon is conveyed from the secondary transfer portion to the fixing unit 20. Between the secondary transferring portion and the fixing roller is further provided a transfer material loop (bend) detection unit (not illustrated) during transfer/fixing, which controls the bending of the transfer material S at a rotation speed of the fixing roller to prevent a not-fixed image from touching other components or so as not to pull the transfer material S. After heat-fixing of the toner image by the fixing unit 20, the transfer material S is discharged outside of the main body by the discharge roller pair 23, while the image printed surface facing downwardly.

(Configuration of Fixing Unit)

Figure 3:
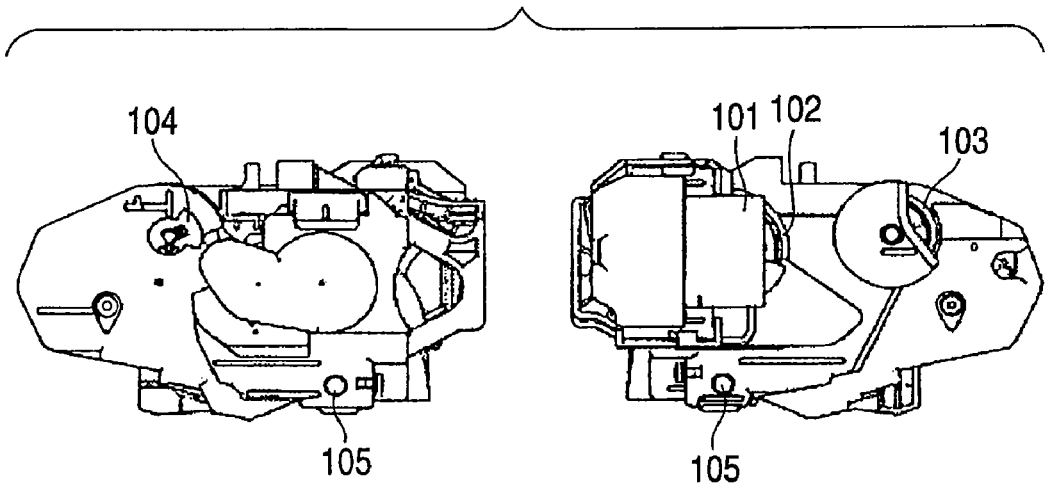
FIG. 3 is a both-side view of the fixing unit of FIG. 2.

FIG. 2 is a perspective view of the fixing unit 20, and FIG. 3 is a both-side view of the fixing unit 20. In FIGS. 2 and 3, the fixing unit 20 includes a fixing unit-side drawer connector 101, an interface gear 102, an interface gear 103, and a pressure release detection flag (a first flag) 104. The fixing unit 20 is further provided with the transfer material detection flag 210 and a fixing unit alignment shaft 105 that fixes the position of the fixing unit 20 inside the main body of the image forming apparatus 100. The transfer material detection flag 210 is an integrally molded product made of resin, including the portion 210*a* that comes into contact with the transfer material and the flag portion (the second flag) 210*b* that acts on the second fixing unit attachment detection portion (optical sensor) 211.

Figure 4:
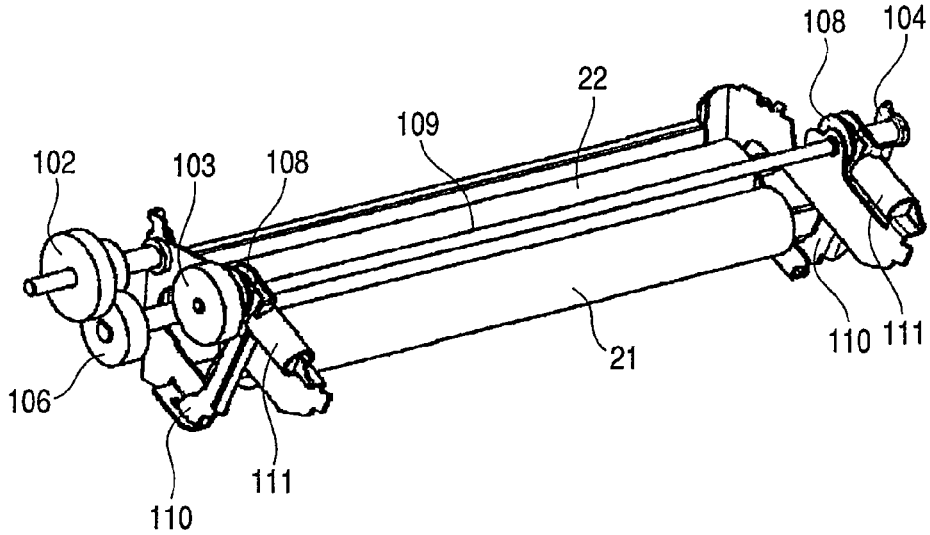
FIG. 4 is a perspective view of the interior configuration of the fixing unit of FIG. 2 (the state where the exterior thereof is removed).

FIG. 4 is a perspective view of the fixing unit when the exterior thereof is removed. As illustrated in FIG. 4, the interface gear 102 is a rotatable idler gear that transmits a driving force transmitted from the apparatus main body to a pressure roller gear 106, so as to rotate the pressure roller 22.

Figure 5:
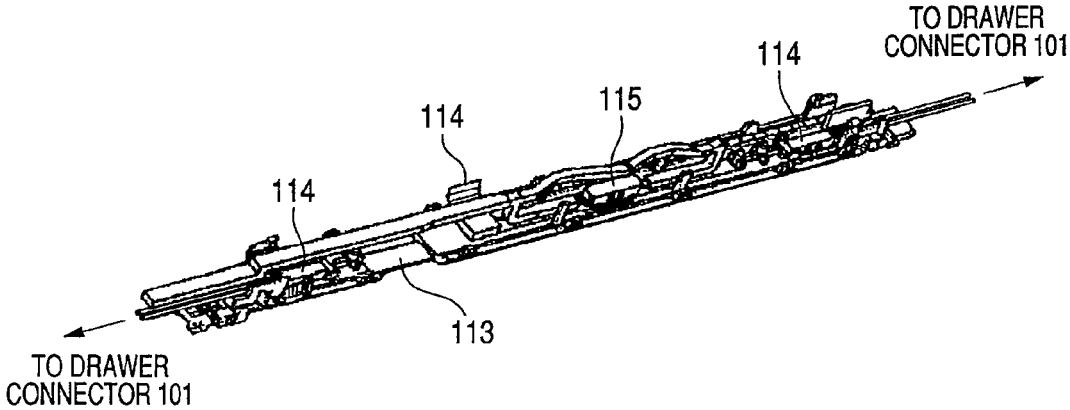
FIG. 5 is a perspective view of the configuration of electric components such as a heater and a temperature detection element provided inside a fixing roller of the fixing unit of FIG. 2.

The fixing roller 21 with a heater 113 as a heating device built therein is provided with a thermistor 114 and a thermo-switch 115. The thermistor 114 detects a temperature of the fixing roller 21 to control a temperature of the heater 113, and a temperature of a nip portion between the fixing roller pair 21, 22 is optimized based on the output from the thermistor 114. The thermo-switch 115 shuts off electricity supply when the temperature of the heater 113 rises abnormally. Then, all of the heater 113, the thermistor 114, and the thermo-switch 115 are connected with the drawer connector 101 on the fixing unit side (see the drawer connector 101 in the direction of the arrows at both ends of FIGS. 5 and 2).

The fixing unit 20 is provided with a contact-pressure release mechanism for the fixing roller pair 21, 22. This contact-pressure release mechanism includes the interface gear 103, a clearance cam 108, and the pressure release detection flag 104, which are attached coaxially with a pressure release shaft 109. Then, when a driving force is transmitted to the interface gear 103 from a motor on the image forming apparatus main body side, the pressure release shaft 109, the clearance cam 108, and the pressure release detection flag 104 rotate concurrently.

When a pressure applied to the fixing nip portion formed between the fixing roller pair 21, 22 is released, a force to pull out the transfer material S can be reduced when a paper jam of the transfer material S is handled, so that usability can be improved. Further, pressure is released when the apparatus is not used for a long time or when a power supply is turned OFF, whereby elastic body layers of the fixing roller 21 and the pressure roller 22 that are brought into contact with each other under pressure can be made free from permanent deformation.

Figure 6:
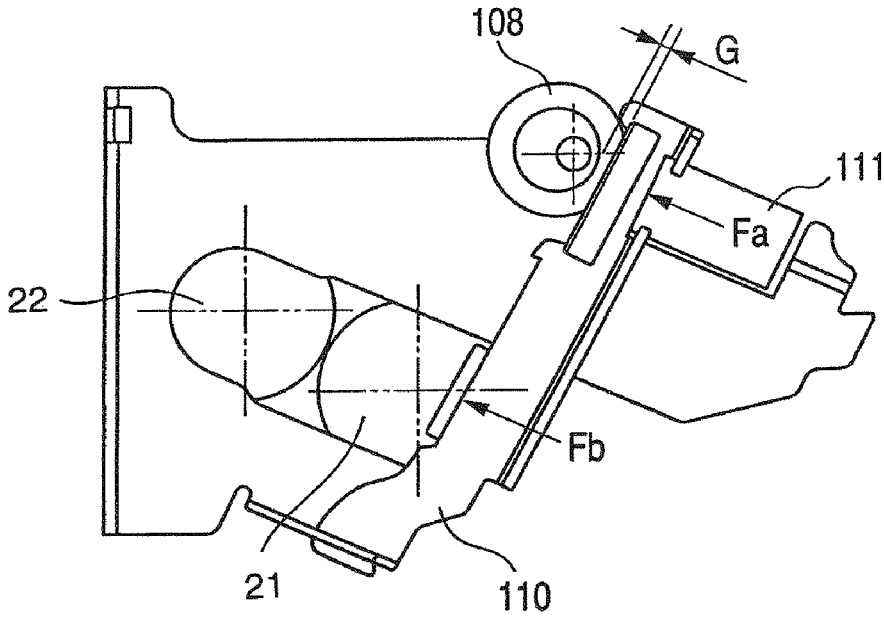
FIG. 6 describes a pressure state of a contact-pressure release mechanism of the fixing unit of FIG. 2.

At the front end of a pressure plate metal 110, a pressure spring 111 is attached, which allows the pressure plate metal 110 urged by the spring 111 to push the end portion of the fixing roller 21, thus securing a pressing force of the fixing roller pair 21, 22. During a normal operation, a small gap G is provided between the pressure plate metal 110 and the clearance cam 108. Therefore, in this state the entire pressing force Fa is applied from the pressure spring 111 to the end portion of the fixing roller 21 via the pressure metal plate 110 (force Fb) (FIG. 6 (pressurizing state by contact)).

Figure 7:
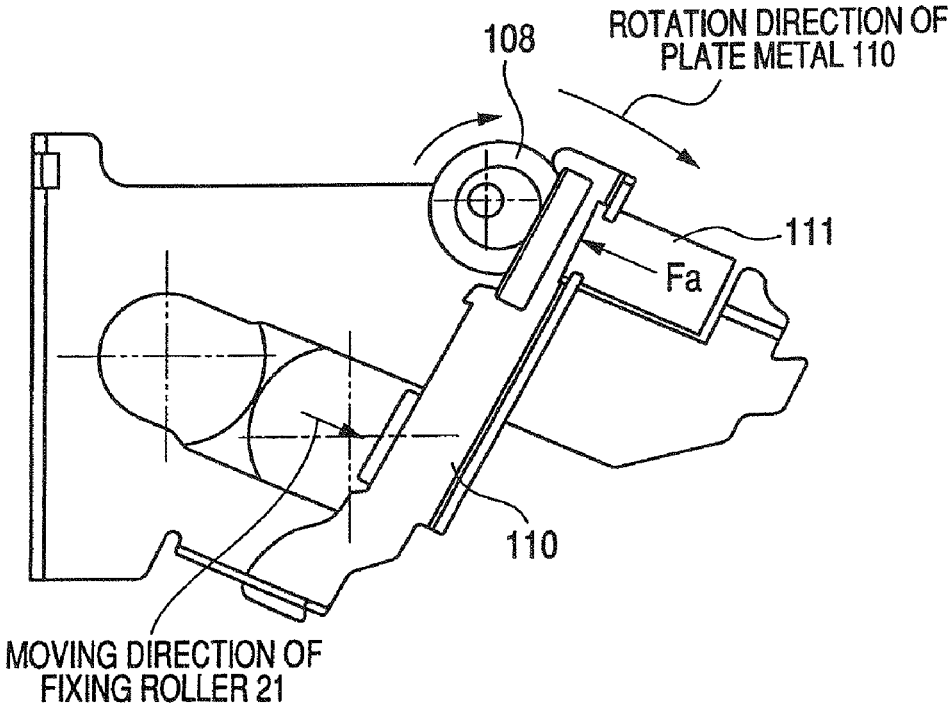
FIG. 7 describes a reduced-pressure state of the contact-pressure release mechanism of the fixing unit of FIG. 2.

On the other hand, when the apparatus is not used for a long time, the power supply is turned OFF, or a paper jam occurs, the clearance cam 108 presses the pressure plate metal 110 upwardly, so that the pressing force of the pressure spring 111 applied to the fixing roller 21 can be decreased by about 80% (FIG. 7 (reduced pressure state due to clearance).

The transfer material detection flag 210 is provided in the fixing unit 20 and on the downstream side in the transfer material conveying direction of the fixing roller pair 21, 22, and sways when the transfer materials S comes into contact with the portion 210*a*. The apparatus main body is provided with a photo-interrupter (the second fixing unit attachment detection unit) 211 corresponding to the second flag 210*b*, thus enabling detection whether the fixing unit 20 generates a paper jam of the transfer material S pinched for conveying and winding of the transfer material S around the fixing roller pair 21, 22 or not.

The transfer material detection flag 210 is pushed upward by the transfer material S only when the fixing unit 20 conveys the transfer material S. In order to detect this state, the transfer material detection flag 210 is always urged in the direction shielding the transfer material S by a helical torsion spring (not illustrated) with a small force of about 4 to 10 gf.

Figure 8:
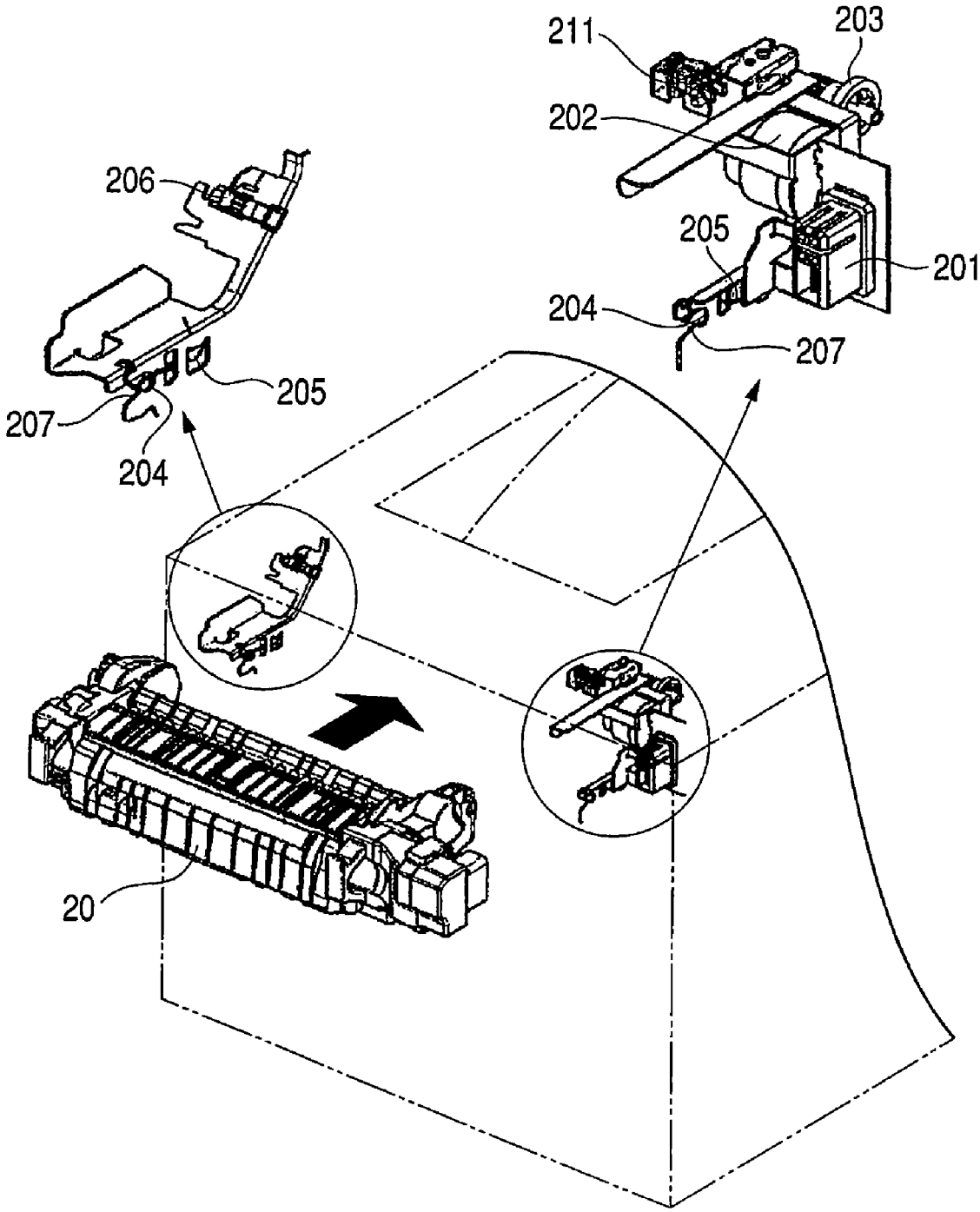
FIG. 8 is a perspective view illustrating a positional relationship between a first fixing unit attachment detection portion 206 and a fixing unit 20 and a positional relationship between a second fixing unit attachment detection portion 211 and the fixing unit 20.
Figure 9:
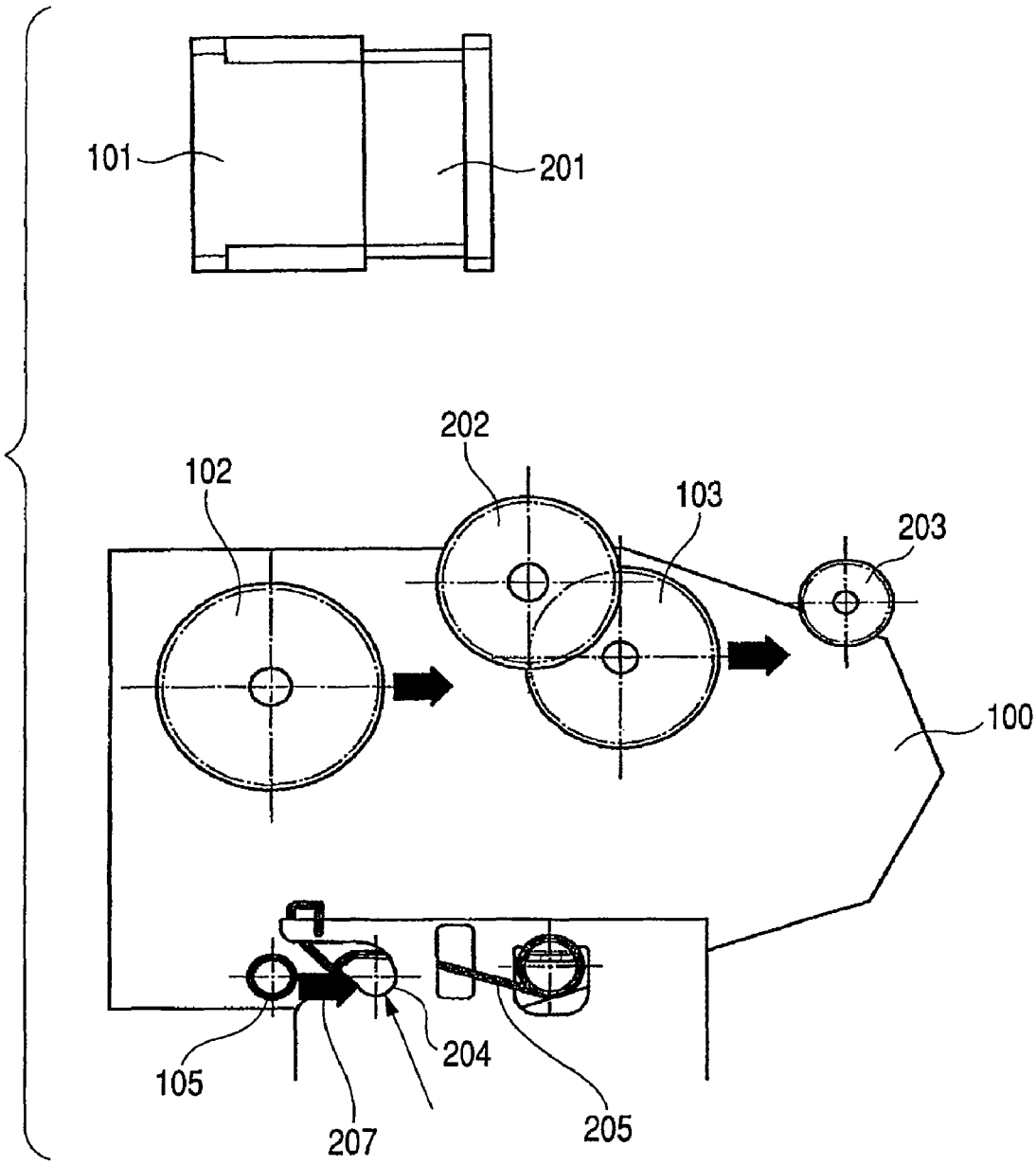
FIG. 9 illustrates a state while the fixing unit 20 is being attached to the apparatus main body.
Figure 10:
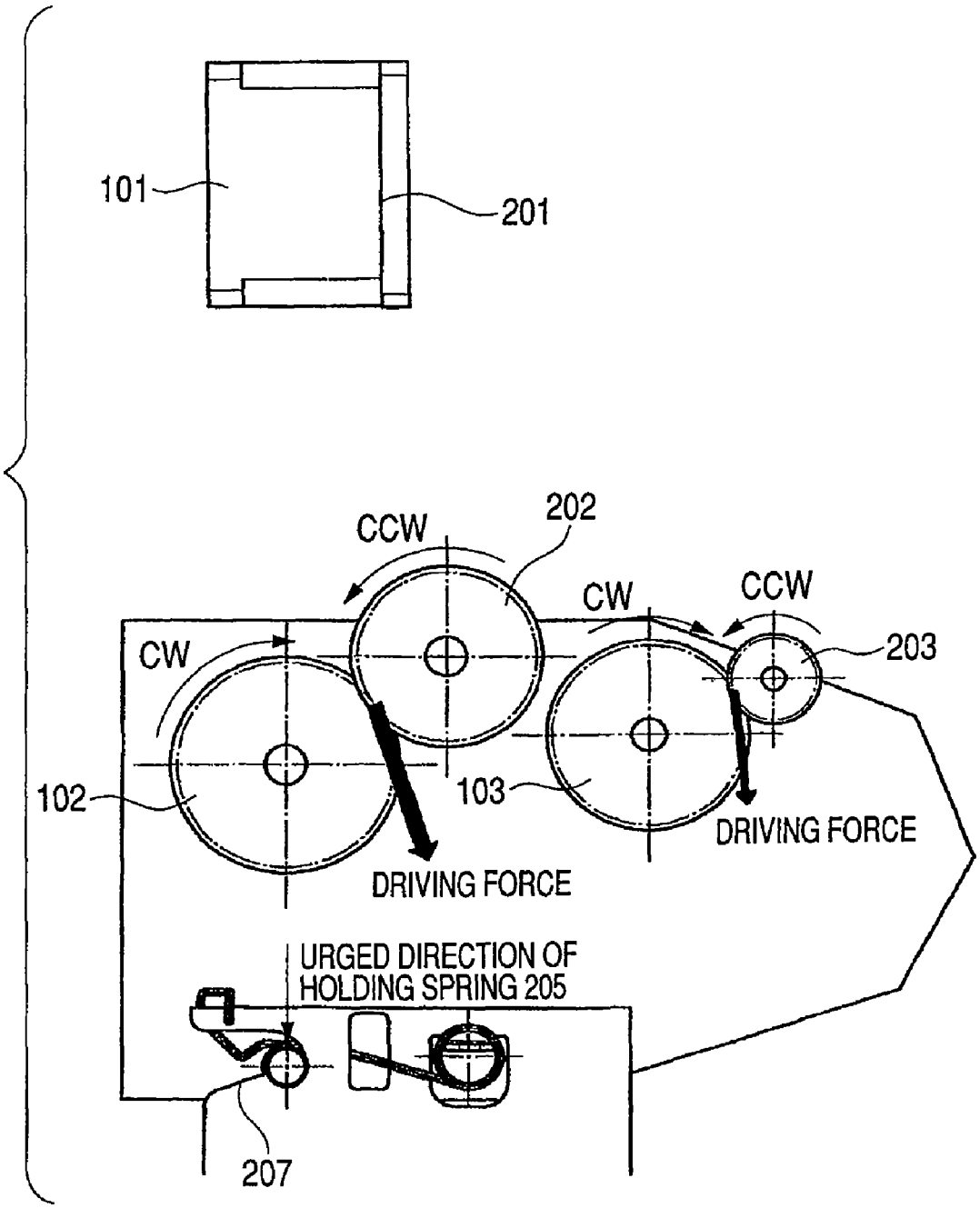
FIG. 10 illustrates a state where the fixing unit 20 is attached to the apparatus main body.
Figure 11:
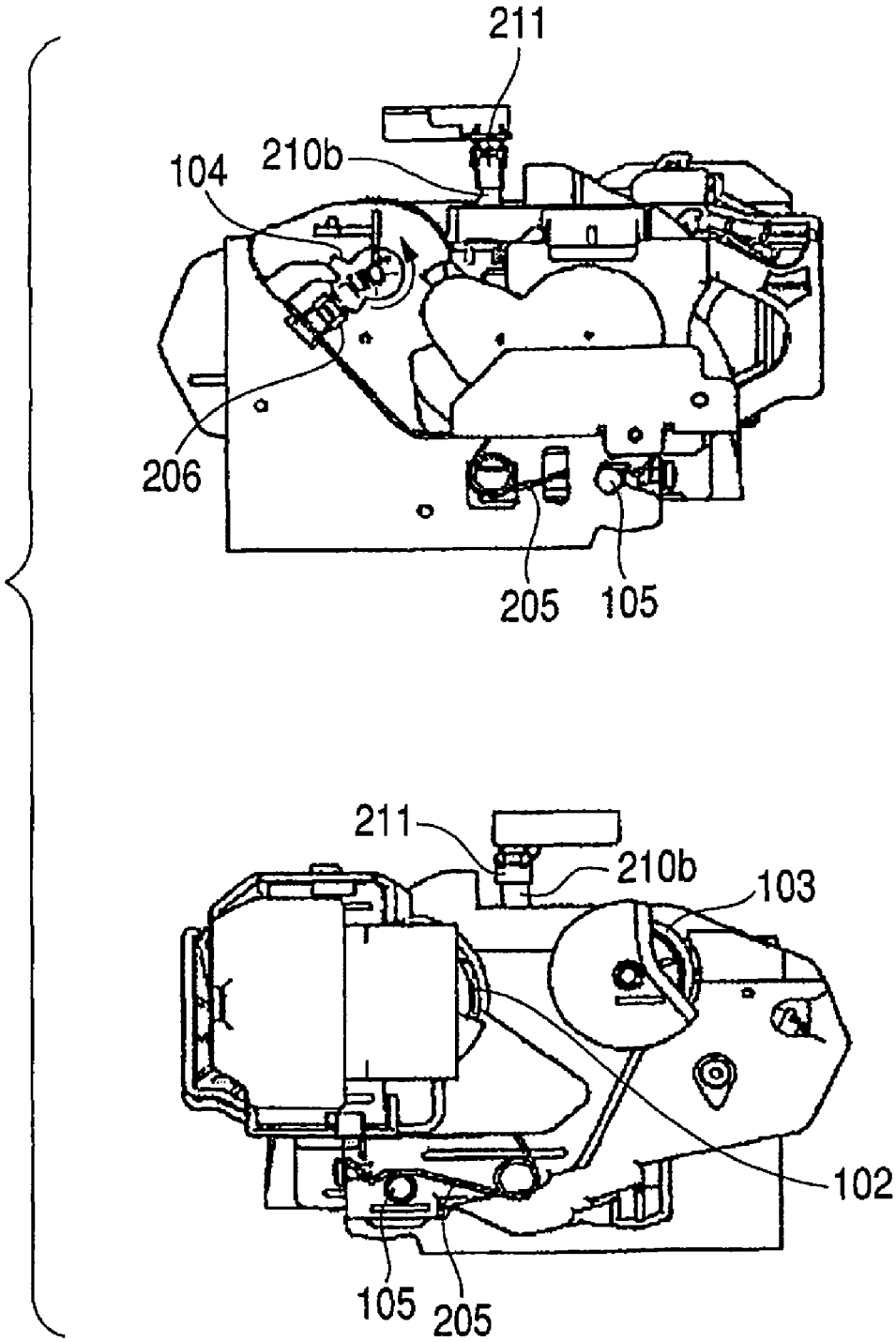
FIG. 11 illustrates a positional relationship between the first fixing unit attachment detection portion 206 and the first flag 104 on the fixing unit 20 side and a positional relationship between the second fixing unit attachment detection portion 211 and the second flag 210*b* on the fixing unit 20 side when the fixing unit 20 is attached to the apparatus main body.

Referring now to FIGS. 8, 9, 10 and 11, the following describes the state where the fixing unit 20 is attached. FIG. 8 is a perspective view illustrating a positional relationship between a first fixing unit attachment detection portion 206 described later and the fixing unit 20 and a positional relationship between the second fixing unit attachment detection portion 211 and the fixing unit 20. FIG. 9 illustrates a state while the fixing unit 20 is being attached to the apparatus main body. The upper part of FIG. 9 illustrates a state while the drawer connector is being connected. FIG. 10 illustrates the state where the fixing unit 20 is attached to the apparatus main body. The upper part of FIG. 10 illustrates the state where the drawer connecter has been completely connected. FIG. 11 illustrates a positional relationship between the first fixing unit attachment detection portion 206 and the first flag 104 on the fixing unit 20 side and a positional relationship between the second fixing unit attachment detection portion 211 and the second flag 210*b* on the fixing unit 20 side when the fixing unit 20 is attached to the apparatus main body. The fixing unit 20 is attached substantially in the horizontal direction with respect to the apparatus main body. The apparatus main body is provided with a drawer connector 201 on the main body side that is fitted with the drawer connector 101 on the fixing unit side to establish electrical connection and an interface gear 202 on the main body side that transmits a driving force to the interface gear 102.

The apparatus main body is further provided with an interface gear 203 on the main body side that transmits a driving force to the interface gear 103, an engage hole 204 with which the fixing unit alignment shaft 105 engages, and a pressure bar spring 205 that urges the fixing unit alignment shaft 105. The apparatus main body is further provided with the photo-interrupter (the first fixing unit attachment detection portion) 206 corresponding to the pressure release detection flag (the first flag) 104, where the photo-interrupter 206 can detect a light-shielding state and a transmitted state based on a rotary phase of the pressure release detection flag 104, thus enabling detection of a contact-pressure state between the fixing roller pair 21, 22.

The fixing unit alignment shaft 105 engages with the engage hole 204 on the apparatus main body side, whereby the fixing unit 20 is attached to a predetermined position in the apparatus main body. A slope 207 is provided before the engage hole 204, and the fixing unit alignment shaft 105 slides along the slope 207 towards the engage hole 204 and engages therewith during the attachment of the fixing unit 20.

During the sliding along the slope 207, the fixing unit alignment shaft 105 is urged downwardly by the pressure bar spring 205. Such an urging force achieves a sense of clicking when the fixing unit alignment shaft 105 engages with the engage hole 204. Such a sense of clicking allows a service man and a user to recognize that the fixing unit 20 surely is attached to the apparatus main body.

When the fixing unit alignment shaft 105 engages with the engage hole 204, the interface gear 102 engages with the interface gear 202 and the interface gear 103 engages with the interface gear 203. Since the interface gear 202 transmits a driving force to the interface gear 102, the interface gear 202 rotates in the direction of CCW and the interface gear 102 rotates in the direction of CW.

Since the interface gear 203 transmits a driving force to the interface gear 103, the interface gear 203 rotates in the direction of CCW and the interface gear 103 rotates in the direction of CW.

Thus, a driving force generated between the interface gear 102 and the interface gear 202 and a driving force generated between the interface gear 103 and the interface gear 203 act in the directions of the arrows in FIG. 10. Thereby, when the driving forces act on the fixing unit 20, a force acts toward the inside of the engage hole 204 provided in the apparatus main body, thus enabling the fixing unit 20 to be attached stably to the apparatus main body. Herein, both of the gear 202 and the gear 203 are driven by one motor (not illustrated) provided in the apparatus main body. During a printing process (fixing processing), this motor on the apparatus main body side rotates the gear 202, thus rotating the pressure roller 22. At this time, since power transmission from the motor to the gear 203 is shut off, the gear 203 does not rotate. When a pressure applied to the fixing nip portion is released (decreased), the motor is reversed, whereby the gear 203 rotates and the cam 108 rotates. At this time, since power transmission from the motor to the gear 202 is shut off, the gear 202 does not rotate.

As described above, the fixing unit 20 is provided with the pressure release detection flag 104 and the transfer material detection flag 210, and the present embodiment uses these flags as a fixing unit attachment detection unit to detect that the both end portions of the fixing unit 20 in the longitudinal direction are surely attached to the predetermined position of the apparatus main body.

To this end, the pressure release detection flag (the first flag) 104 is disposed in the direction opposite of the driving side of the fixing unit 20 (one end portion of the fixing unit 20 in the longitudinal direction), and the flag portion (the second flag) 210*b* of the transfer material detection flag 210 is disposed on the driving side of the fixing unit 20. The apparatus main body is provided with the first fixing unit attachment detection portion 206 at the position corresponding to the first flag 104 and the second fixing unit attachment detection portion 211 at the position corresponding to the second flag 210*b*. That is, the first fixing unit attachment detection portion 206 is provided at a position on the image forming apparatus main body different from the position where the main body-side connector 201 of the image forming apparatus main body is disposed in the longitudinal direction of the fixing unit. The second fixing unit attachment detection portion 211 is provided at a position on the image forming apparatus main body different from the position where the main body-side connector 201 of the image forming apparatus main body is disposed and the position where the first fixing unit attachment detection portion 206 is disposed in the longitudinal direction of the fixing unit.

The first flag 104 provided in the fixing unit 20 has a shape such that a part of the phase in the rotary direction shields the photo-interrupter 206. When the gear 203 rotates while the fixing unit 20 being attached to the apparatus main body, the flag 104 shields light traveling from a light-emission portion to a light-reception portion of the photo-interrupter 206 during the rotation, and therefore it can be judged that the fixing unit 20 exists in the image forming apparatus main body. Herein, in the present embodiment, the first flag 104 shields light of the photo-interrupter 206 at a phase where the pressure of the fixing nip portion is released.

The second flag 210*b* provided in the fixing unit 20 has a home position that is the state where the transfer material is not in contact with the portion 210*a* as a part of the transfer material detection flag, i.e., at the phase of FIG. 11. Thus, when the transfer material is not pinched at the fixing nip portion, the second flag 210*b* has a phase of protruding from the upper portion of the fixing unit 20. When the fixing unit 20 is attached to the apparatus main body, the second flag 210*b* shields light traveling from a light-emission portion to a light-reception portion of the photo-interrupter 211, and therefore it can be judged that the fixing unit 20 exists in the image forming apparatus main body.

Therefore, when the fixing unit 20 in the longitudinal direction as a whole is not attached to the predetermined position with reference to the apparatus main body, the pressure release detection flag 104 or the flag 210*b* does not reach the position of the photo-interrupter 206 or 211 provided in the apparatus main body. As a result, it can be detected a not-attachment state or an insufficient attachment state of the fixing unit 20. FIG. 12 illustrates a relationship between the detection state by the pressure release detection flag 104 and the transfer material detection flag 210 and the attachment state of the fixing unit 20 to the main body. In FIG. 12, "light-shielding" indicates the state where "the fixing unit exists", and "transmitted beam" indicates the state where "the fixing unit does not exist".

When a judgment unit provided in a control unit that controls the image forming apparatus main body detects an attachment failure, a display panel displays the attachment failure of the fixing unit, thus urging a service man and a user to attach the fixing unit again.

As shown in FIG. 12, when light is transmitted at the transfer material detection unit only, the fixing unit has either of the state of an attachment failure on the transfer material detection portion side in the longitudinal direction of the fixing unit and the state of existence of the transfer material S, and therefore the display panel displays the both states. Note here that when another detection unit other than the transfer material detection unit also detects the existence of sheet, for example, when the transfer-fixing loop detection unit detects existence of the transfer material S, existence of the transfer material only is displayed.

In this way, in the configuration of the present embodiment, a connector portion that feeds electricity to the fixing unit is not used to detect the attachment of the fixing unit, but a plurality of portions other than the connector portion is used for the attachment detection in the longitudinal direction of the fixing unit. Therefore, jamming, an image formation defect, and trouble of the fixing unit 20 caused by the image formation while the fixing unit 20 not being attached correctly can be prevented.

Further, the pressure release detection flag 104 and the transfer material detection flag 210 double as the fixing unit attachment detection unit, and therefore an attachment failure of the fixing unit 20 can be detected without providing a new detection unit, i.e., without increasing cost, and can prevent an image formation defect and breakage of the fixing unit 20 caused thereby.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

For instance, in the present embodiment, another fixing unit attachment detection unit is further provided in addition to the pressure release detection flag 104 and the transfer material detection flag 210 as the attachment detection units of the fixing unit 20. Thereby, paper jam and a pressure release mechanism failure can be dealt with separately from the not-attached state of the fixing unit for display to a service man and a user.

This application claims the benefit of Japanese Patent Application No. 2008-062500, filed Mar. 12, 2008, which is hereby incorporated by reference in its entirety.

What is claimed is:

1. An image forming apparatus that forms a toner image on a recording material, then heats and fixes the toner image on the recording material and outputs the recording material, comprising:

an image forming apparatus main body;

a fixing unit detachably attached to said image forming apparatus main body, said fixing unit including a unit-side connector that electrically connects with a main body-side connector of said image forming apparatus main body when said fixing unit is attached to said image forming apparatus main body to receive electric power from said image forming apparatus main body;

a first fixing unit attachment detection portion that is disposed at a position on said image forming apparatus main body different from a position where said main body-side connector of said image forming apparatus main body is disposed in a longitudinal direction of said fixing unit; and a second fixing unit attachment detection portion that is disposed at a position on said image forming apparatus main body different from a position where said main body-side connector of said image forming apparatus main body is disposed and a position where said first fixing unit attachment detection portion is disposed in the longitudinal direction of said fixing unit, wherein each of said first fixing unit attachment detection portion and said second fixing unit attachment detection portion includes an optical sensor to detect presence or absence of said fixing unit.

2. An image forming apparatus according to claim 1, wherein said fixing unit includes a first flag acting on said first fixing unit attachment detection portion and a second flag acting on said second fixing unit attachment detection portion.

3. An image forming apparatus according to claim 1, wherein said first fixing unit attachment detection portion includes a function to detect a pressure state of a fixing nip portion formed in said fixing unit, said fixing nip portion pinching the recording material for conveying, and said second fixing unit attachment detection portion includes a function to detect presence or absence of the recording material.

4. An image forming apparatus according to claim 1, further comprising a judgment portion that judges an attachment state of said fixing unit, and said judgment portion judges the attachment state as normal when both of said first fixing unit attachment detection portion and said second fixing unit attachment detection portion detect presence of said fixing unit.

* * * * *